US005657030A

United States Patent [19]

Peck et al.

[11] Patent Number: 5,657,030

[45] Date of Patent: Aug. 12, 1997

[54] COLLAPSIBLE SINGLE OR MULTIELEMENT RHOMBIC ANTENNAS

[76] Inventors: William H. Peck, 9780 Lindero, Montclair, Calif. 91763; Wayne C. Crouch, 110 East Park, Edwardsville, Ill. 62025

[21] Appl. No.: 465,647

[22] Filed: Jun. 5, 1995

Related U.S. Application Data

[63] Continuation-in-part of Ser. No. 121,335, Sep. 14, 1993, abandoned.

[51] Int. Cl.[6] ..... H01Q 11/06

[52] U.S. Cl. ..... 343/733; 343/878

[58] Field of Search ..... 343/733, 738, 343/739, 866, 867, 742, 744, 878; H01Q 11/06

[56] References Cited

U.S. PATENT DOCUMENTS

| | | | |
|---|---|---|---|
| 1,721,128 | 7/1929 | Mathiesen | 343/871 |
| 2,126,295 | 8/1938 | Warren | 343/733 |
| 2,145,024 | 1/1939 | Bruce | 343/733 |
| 2,194,554 | 3/1940 | Katzin | 343/733 |
| 2,207,504 | 7/1940 | Bohm | 343/733 |
| 2,244,628 | 6/1941 | Kotowski | 343/733 |
| 2,247,739 | 7/1941 | Werndl | 343/733 |
| 2,247,744 | 7/1941 | Bohm | 343/733 |
| 2,264,718 | 12/1941 | Rust | 333/32 |
| 2,485,773 | 10/1949 | Posthumus | 343/733 |
| 2,700,733 | 1/1955 | Brueckmann | 343/733 |
| 4,138,682 | 2/1979 | Doherty | 343/742 |
| 4,152,708 | 5/1979 | Boucher | 343/880 |
| 4,229,742 | 10/1980 | Rotunda | 343/742 |
| 4,249,185 | 2/1981 | De Cesari | 343/871 |
| 4,395,714 | 7/1983 | Takeda | 343/725 |
| 4,667,204 | 5/1987 | Hedrick | 343/725 |
| 5,198,831 | 3/1993 | Burrell | 343/895 |

*Primary Examiner*—Michael C. Wimer

*Attorney, Agent, or Firm*—Polster, Lieder, Woodruff & Lucchesi, L.C.

[57] ABSTRACT

A light-weight, collapsible, single or multi element rhombic antenna is disclosed having at least two wire antenna elements for receiving and transmitting electromagnetic waves. The antenna elements are supported in a rhombic shape by an antenna frame. The frame includes four nonconductive legs extending radially outwardly from a center support. At least one of the legs is detachably engaged to the center support. Each leg has a nonconductive cross arm support orthogonally mounted to its outwardly extending end for supporting the antenna wire elements in parallel rhombic formations. An integrated feed network combines the electromagnetic waves. A translation device is coupled to the integrated feed network to convert the electromagnetic waves into a desired output signal. The antenna can be mounted on a mast for either horizontally or vertically polarized operation.

14 Claims, 9 Drawing Sheets

COLLAPSIBLE SINGLE OR MULTIELEMENT RHOMBIC ANTENNAS

CROSS REFERENCE TO RELATED APPLICATION

This application is a continuation-in-part of U.S. patent application Ser. No. 08/121,335, filed Sep. 14, 1993, abandoned.

BACKGROUND OF THE INVENTION

This invention relates to antennas, and in particular collapsible single or multi element rhombic antennas for use in the transmission and reception of horizontally or vertically polarized electromagnetic waves.

Radio communication has been possible between United States and Great Britain since 1925 using rhombic antennas. The versatility of the rhombic antenna makes it well suited for high gain transmission and reception of radio signals. Prior art rhombic antennas used for radio frequencies were large fixed structures that required several acres of land and hundreds of feet of wire to operate. For example, U.S. Pat. No. 2,145,024 which issued to Bruce on Jan. 24, 1939, discloses the use of a plurality of rotatable and adjustable rhombic antennas to receive and transit horizontally and vertically polarized electromagnetic waves. These antennas require bulky and cumbersome support structures or frames to support the antennas. The later development of multi element or arrayed rhombic antennas only exaggerated these structural problems. With the development of "direct TV" applications, low cost, easy to install, antennas are expected to have wide markets. Therefore, it is desirable to develop a rhombic antenna which is easily installed in either a vertical or horizontal position without requiring a cumbersome support structure. It is also desirable to develop a collapsible antenna which can be easily broken down and reassembled. Such a collapsible antenna should be light weight and compact when broken down so that it can be easily transported or shipped from one location to another.

Rhombic antennas typically include a translation device mounted at a remote location outside of an enclosure delimited by the wire antenna elements. The Bruce patent discloses a translation device for summing the received signal which is mounted behind or externally to this enclosure. Modem translation devices typically include a down converter for amplifying and converting electromagnetic radiation to an analog or digital signal (an electric current) at the desired reception frequency and an impedance matching network for matching the impedance of the antenna feed to the input impedance of the translation device to produce the desired signal transmission. Such translation devices are protected from the environment by a housing and attached to the antenna elements via a transmission line and a balanced to unbalanced (balun) network. U.S. patents requiring the external mounting of a translation device in a housing positioned outside the enclosure defined between the wire antenna elements include the following: U.S. Pat. No. 5,198,831 to Burrell et al. on Mar. 30, 1993; U.S. Pat. No. 4,249,185 to De Cesari on Feb. 3, 1981; U.S. Pat. No. 4,152,708 to Boucher on May 1, 1979; U.S. Pat. No. 2,264,718 to Rust et al. on Dec. 2, 1941; U.S. Pat. No. 2,244,628 to Kotowski on Jun. 3, 1941; U.S. Pat. No. 2,194,554 to Katzin on Mar. 26, 1940; U.S. Pat. No. 2,145,024 to Bruce on Jan. 24, 1939; and U.S. Pat. No. 1,721,128 to Mathiesen on Jul. 16, 1929. The references suggest that it is necessary to mount the translation devices outside the enclosure defined by the wire antenna elements to prevent the disruption of the antenna's electric field which, in turn, would affect the wire currents and degrade the high gain characteristics. The Applicants are unaware of any prior art rhombic antennas or conductors that teach mounting the translation device inside this enclosure because of the widespread belief that the electrical field of the antenna would degrade the desired signal, thereby causing the antenna not to perform properly. However, such remote mounting outside this enclosure has several drawbacks. Assembly of such antennas is complicated and often requires multiple adjustments. Once assembled, the antennas are often physically unbalanced which restricts mounting ability. It is therefore desirable to develop a rhombic antenna that allows for the mounting of the translation device within the enclosure defined by the wire antenna elements and does not degrade the antenna performance. The translation device could be mounted in a protective housing attached to the outer surface of the antenna frame or in a weather proof cavity defined by the interior surface of the antenna frame or support structure. Such internal mounting within the enclosure provides for easier assembly of the antenna and a more compact and balanced design with low wind resistance.

Prior art teachings also suggest that antenna bandwidth or frequency response are dependent upon the antenna dimensions. As a result, adjustable rhombic antennas such as that disclosed in the Bruce patent were designed which allow for adjustment of the antenna dimensions to vary to the bandwidth. However, Applicants'invention disclosed hereinafter provides an antenna having fixed dimensions which controls the antenna bandwidth by varying the electrical distance between a segment of the wire antenna elements. Such an antenna finds application, for example, as a low cost alternative to existing parabolic antennas currently used in the wireless cable television industry.

SUMMARY OF THE INVENTION

Accordingly, it is an object of our invention to provide a rhombic antenna that couples two or more parallel rhombic wire antenna elements together to increase the antenna gain.

Another object of this invention is to provide a high gain, single or multi-element rhombic antenna that can be easily collapsed and reassembled.

Another object of this invention is to provide a collapsible single or multi element rhombic antenna that is light weight and compact when broken down to allow for easy handling and transportation of the antenna.

Another object of this invention is to provide a collapsible single or multi element rhombic antenna that allows for mounting of a translation device within an enclosure defined by the wire antenna elements.

Another object of this invention is to provide a collapsible single or multi element rhombic antenna that allows for mounting of a translation device inside a weather-proof cavity defined by the interior surfaces of the antenna frame or support structure.

Another object of this invention is to provide a collapsible single or multi element rhombic antenna that has low wind resistance.

Still another object of this invention is to provide a collapsible single or multi element rhombic antenna having an integrated feed network for summing the received signals, impedance matching, and controlling the antenna bandwidth.

Another object of this invention is to provide a multi element rhombic wherein the electrical distance between two segments of the antenna wire is varied to control the antenna bandwidth.

Another object of this invention is to provide a collapsible single or multi element rhombic antenna that will receive either horizontally or vertically polarized electromagnetic waves.

Yet another object of this invention is to provide a collapsible single or multi element rhombic antenna that is environmentally protected and constructed from inexpensive materials.

These and other objects will become apparent to those skilled in the art in light of the following disclosure and accompanying drawings.

In accordance with the invention, generally stated, a light-weight, environmentally protected rhombic antenna is provided which includes at least two wire antenna elements for receiving and transmitting electromagnetic waves. The antenna elements are supported in a rhombic formation by an antenna frame. An integrated feed network combines the antenna element output signals. A translation device is coupled to the integrated feed network either directly or indirectly via a balanced to unbalanced transformer (balun) and transmission line. The translation device detects, amplifies and converts the electromagnetic waves into a desired output signal. The integrated feed network and the translation device are mounted within an enclosure defined by the antenna wire elements. The translation device may be contained within a weather-proof housing mounted to an exterior surface of the antenna frame or disposed within a cavity defined by a portion of an interior surface of the antenna frame. Another aspect of the present invention is to provide a single or multi element, collapsible rhombic antenna having an antenna frame including four nonconductive legs extending radially outwardly from a center support. At least one of the legs is detachably engaged to the center support. Each leg has a nonconductive cross arm support orthogonally mounted to its outwardly extending end. The cross arm supports maintain at least two wire antenna elements in parallel and in rhombic formations. The antenna can be mounted on a mast for either horizontally or vertically polarized operation.

Other objects and features will be apparent and in part pointed out hereinafter.

BRIEF DESCRIPTION OF THE DRAWINGS

The objects of the invention are achieved as set forth in the illustrative embodiments shown in the drawings which form a part of the specification.

Corresponding reference characters indicate corresponding parts throughout the several views of the drawings.

DESCRIPTION OF THE PREFERRED EMBODIMENT

Figure 1:
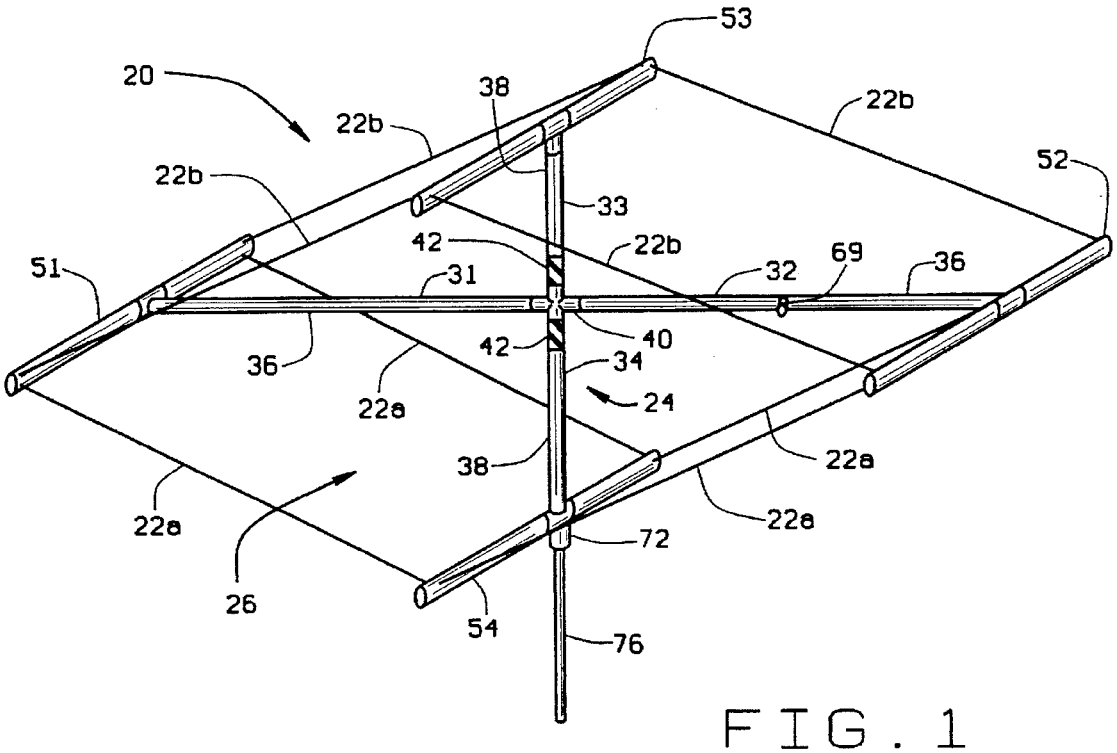
FIG. 1 is a perspective view of a two element rhombic antenna of the present invention positioned for vertically polarized operation.
Figure 2:
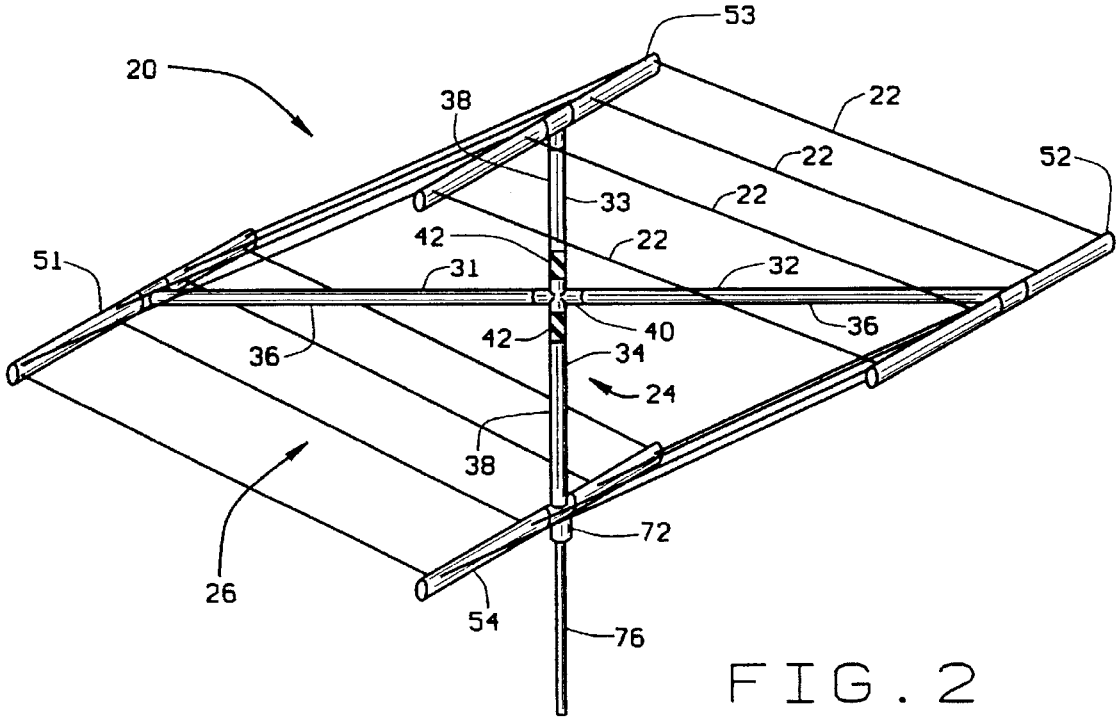
FIG. 2 is a perspective view of a four element rhombic antenna positioned for vertically polarized operation.

Referring now to the drawings, a rhombic antenna is shown, designated generally at 20. The antenna 20 shown in FIG. 1 has two parallel environmentally protected wire antenna elements 22. Each antenna element 22 forms four sides of a rhombus and the area defined between the elements 22 delimits a parallelpiped enclosure 26. The number of (pairs of) antenna wire elements 22 employed can be increased to create any multi element array. For example, FIG. 2 illustrates a rhombic antenna 20 having four wire elements 22. Furthermore, the rhombic antenna 20 may employ only a single antenna wire element 22. Mutual coupling between the elements 22 increases the antenna gain so that each time another (pair of) elements 22 is added the antenna gain increases.

Figure 3:
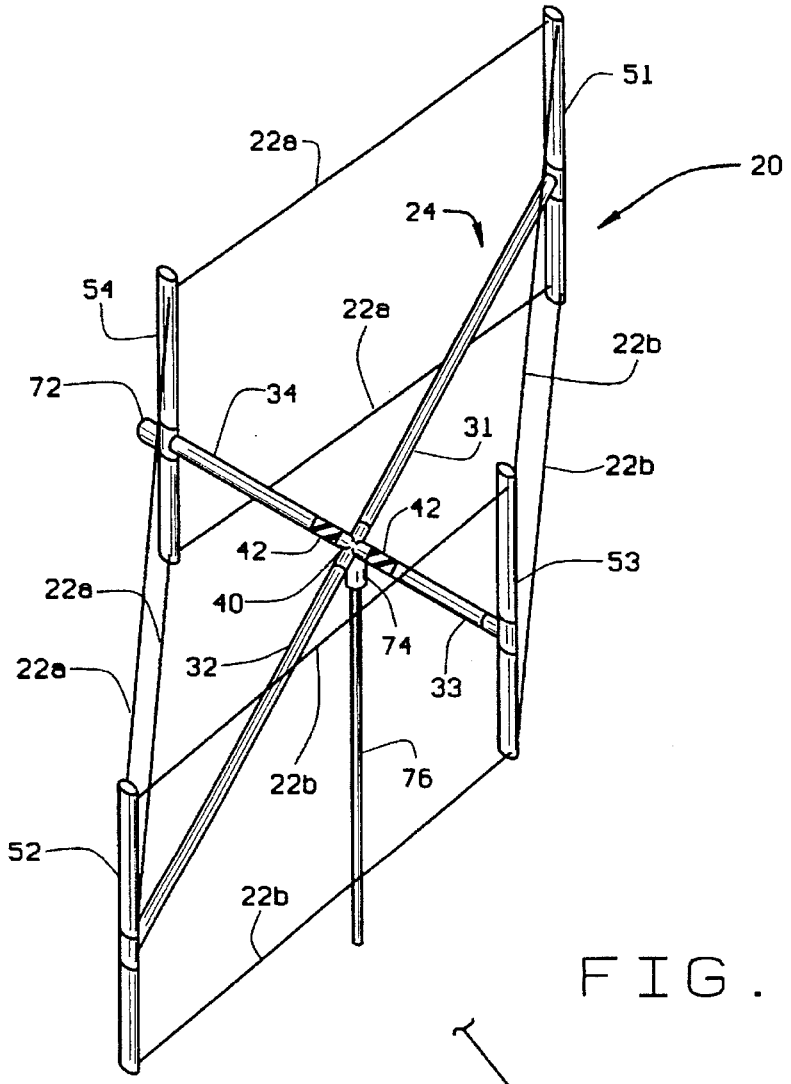
FIG. 3 is a view of the two element rhombic antenna in FIG. 1 positioned for horizontally polarized operation.

For either the single or multi element rhombic antenna, the wire elements 22 are supported in their rhombic shape by an antenna frame or support structure 24. The entire frame 24 is light weight and environmentally protected, preferably constructed of U.V. (ultra violet) resistant P.V.C. (poly vinyl chloride) material. The frame 24 includes four nonconductive legs (rods, beams, support members) 31,32,33, and 34 generally disposed in an X-shape such that two legs 31 and 32 extend coaxially to form a first diagonal of the rhombus and the other two legs 33 and 34 extend coaxially to form a second diagonal of the rhombus. More specifically, legs 31 and 32 are referred to collectively as a boom 36 and legs 33 and 34 are collectively referred to as a short support 38. A center support 40 may be disposed in the location where the legs would otherwise intersect so that the legs 31, 32, 33 and 34 extend radially outwardly from the center support 40. In FIGS. 1–3, legs 31 and 32 are permanently affixed to the center support 40 and each of legs 33 and 34 is detachably engaged to the center support 40 via a connecting device 42. However, this assembly of the legs 31,32,33,34 to the center support 40 is set forth for illustrative purposes to show the collapsible feature of the antenna 20. It is possible to have any number of the legs 31, 32, 33, 34 either permanently affixed to the support 40 or detachably engaged to the support 40.

The connecting device 42 is used to removably mount each collapsible leg to the center support 40. It will be apparent to those skilled in the art that the connecting device 42 may take the form of any embodiment which allows for removably securing the inwardly extending end of a collapsible leg to the connecting device. Depending on the type of connecting device 42 employed, the inwardly extending end of each collapsible leg may need to be adapted to be detachably engageable with the connecting device 42. For example, FIGS. 8A–B, 9, 10, 11, 12 and 13 illustrate six possible embodiments for the connecting devices 42.

Figure 8A:
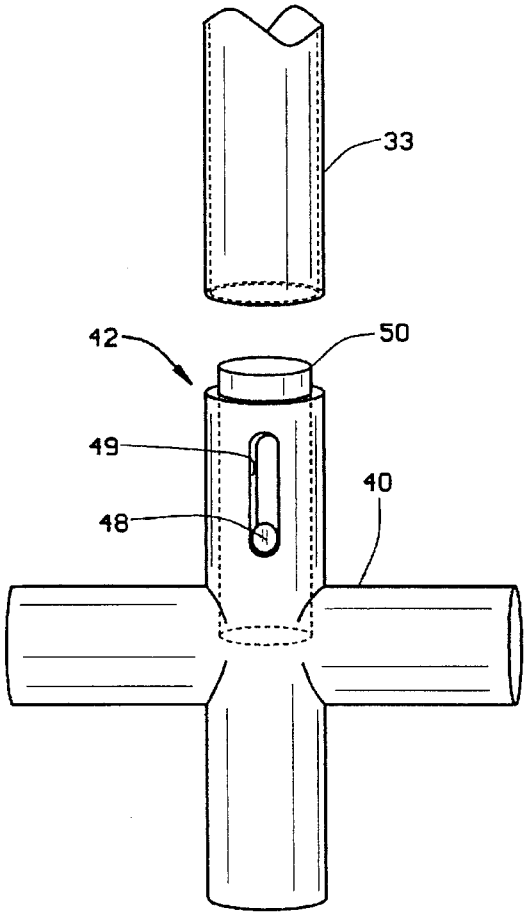
FIG. 8A illustrates a first embodiment of the connecting device employed in the collapsible rhombic antenna in its disengaged or unlocked position.
Figure 8B:
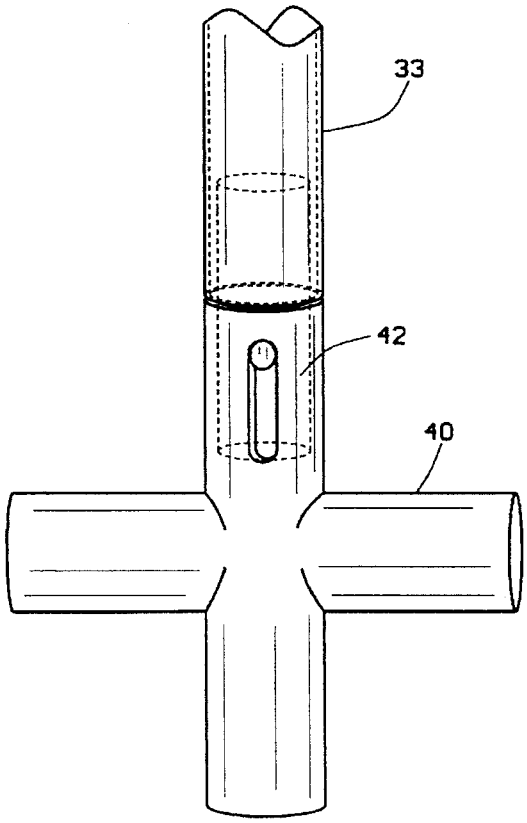
FIG. 8B illustrates the first embodiment of the connecting device in its engaged or locked position.

FIG. 8A shows a first embodiment of the connecting device 42 maintained in its disengaged or unlocked position. In this embodiment, the connecting device includes a cylindrical rod 50 having a spring loaded pin 48 extending outwardly from its axially extending surface. The center support 40 is also modified to have an opening 49 formed therein such that upon assembly of the connecting device 42, the rod 50 is slidably received within center support 40 and the pin 48 extends outwardly through the opening 49 as shown in FIG. 8A. FIG. 8B shows the first embodiment of the connecting device 42 in its engaged or locked position upon assembly of the collapsible leg 33. The inwardly extending end of the leg 33 is adapted to securely receive the outwardly extending end of the rod 50. Rotational movement of the rod 50 is prohibited by the opening 49 in the center support 40.

Figure 9:
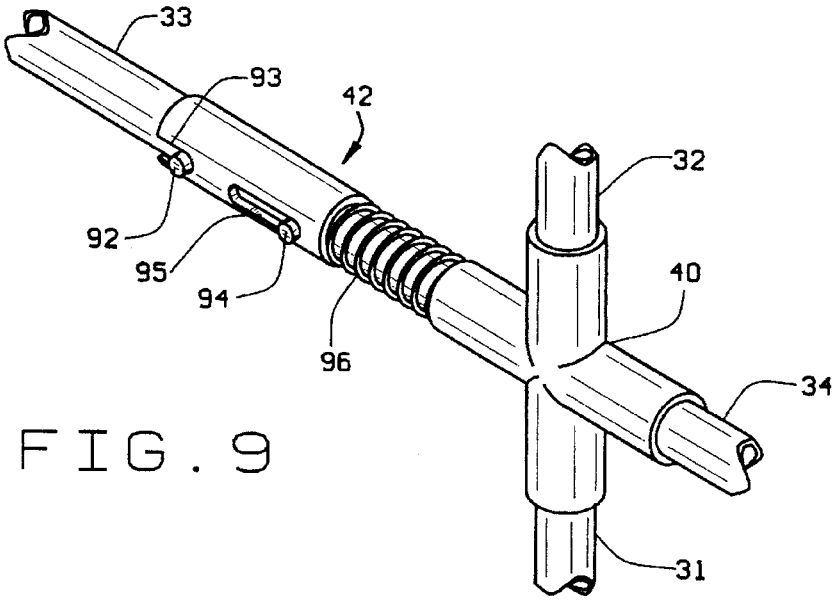
FIG. 9 illustrates a second embodiment of the connecting device in its disengaged or unlocked position.

FIG. 9 depicts a second embodiment of the connecting device 42 including a hollow cylindrical tube having an opening 95 and a slot 93 formed therein. The connecting device 42 is moved inwardly to compress a spring 96. Upon assembly, the leg 33 is inserted into connecting device 42 such that a spring loaded pin 94 associated with the leg 33 is contained within the opening 95 of the connecting device 42 and a pin 92 also associated with the leg 33 is disposed within the slot 93 to prevent movement and rotation of the leg 33 with respect to the connecting device 42. Leg 33 can be slidably removed from the connecting device 42 by compressing spring 96 through inward movement of connecting device 42 and sliding leg 33 out of the connecting device 42.

Figure 10:
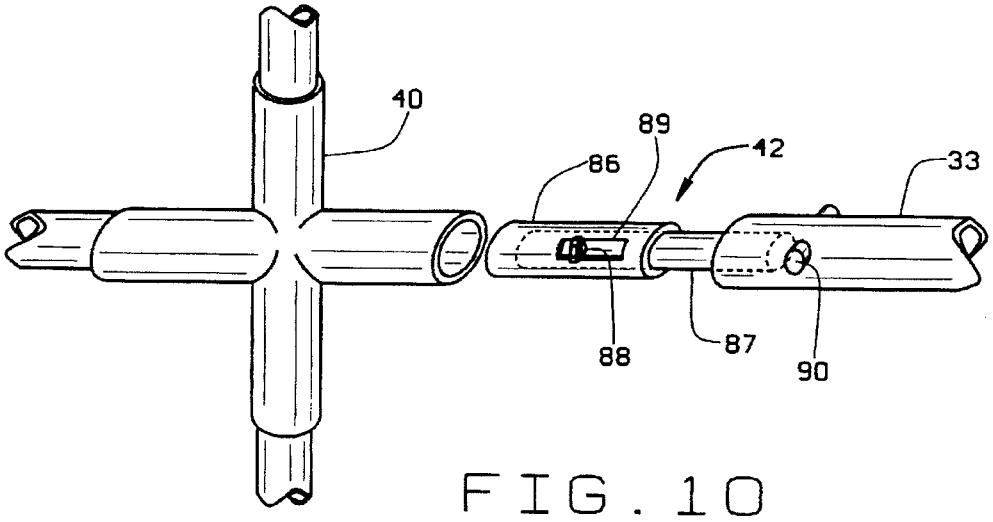
FIG. 10 illustrates a third embodiment of the connecting device in its engaged or locked position.
Figure 11:
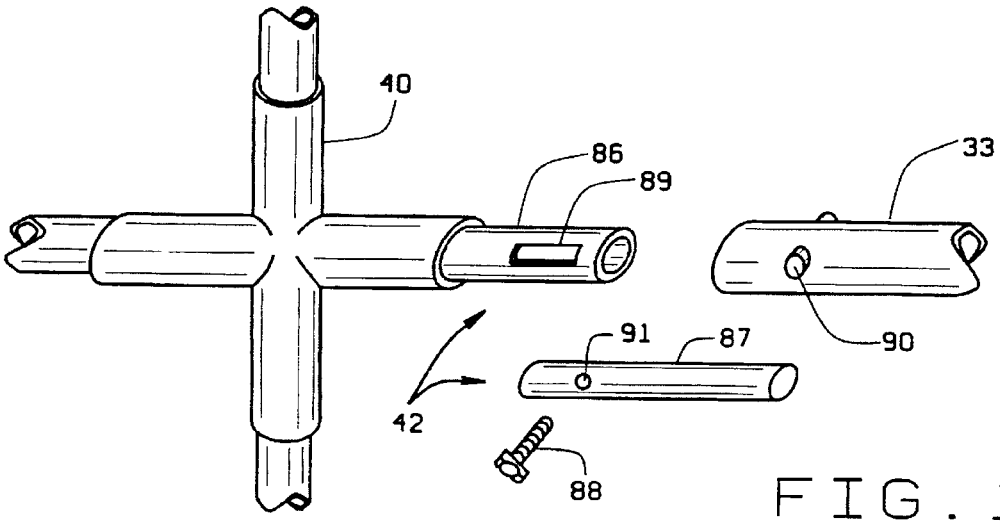
FIG. 11 is an exploded view of a fourth embodiment of the connecting device used in the present invention.

A third embodiment of the connecting device 42 is shown in FIGS. 10 and 11 wherein the leg 33 is adapted to have a pin 90 extending therethrough in the vicinity of its the inwardly extending end. The connecting device 42 includes rod 87 having a cylindrical hole 91 extending radially therethrough in the vicinity of one of its ends and a hollow cylindrical tube 86 having an opening 89 formed therein. Upon assembly, one end of rod 87 fits snugly within the leg 33 so as to rest against pin 90 as shown in FIG. 10 such that pin 90 prevents further insertion of rod 87 into the leg 33. The other end of the rod 87 having the hole 91 formed therein is inserted into the tube 85 so that the hole 91 is aligned within the opening 89. A fastener 88 is inserted through the opening 89 and then into secure engagement within the hole 91 to prevent horizontal or rotational movement of the rod 87 with respect to the tube 86.

Figure 12:
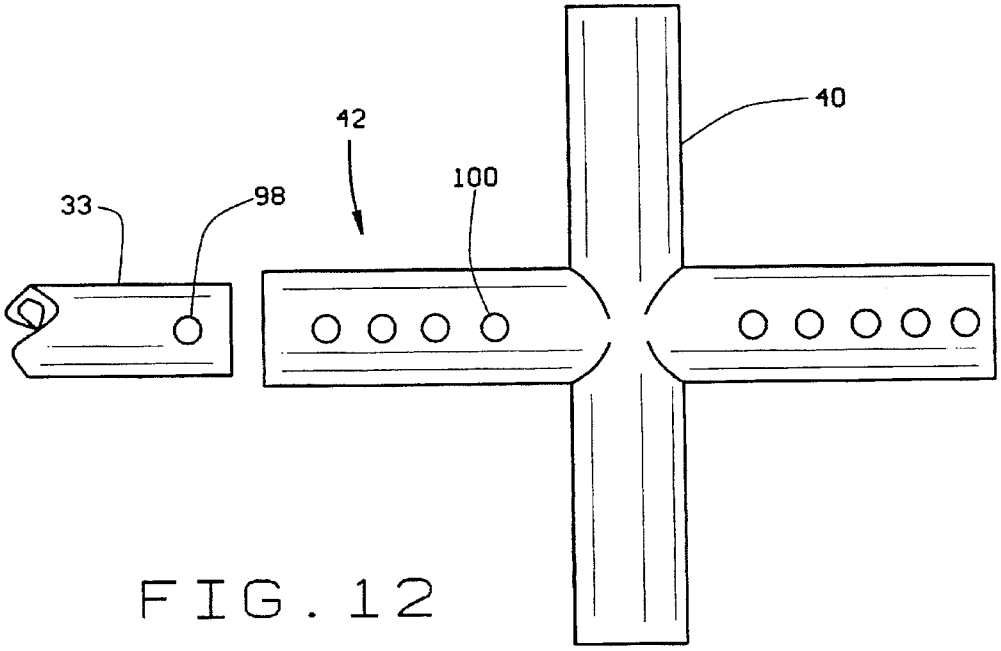
FIG. 12 illustrates a fifth embodiment of the connecting device in its disengaged or unlocked position.

A spring loaded pin 98 may be added to the legs 33 in the vicinity of its inwardly extending end as shown in FIG. 12 as part of a fourth embodiment of the connecting device 42. The connecting device also includes a hollow cylindrical tube extending radially outwardly from to the center support 40 which has a plurality of openings 100 formed therein. The pin 98 is maintained in its compressed position when the leg 33 is inserted into the cylindrical tube upon assembly. When the pin 98 is aligned with an opening 100, the pin 98 is released into its extended position so that the pin 98 protrudes outwardly through the opening 100 thereby locking the leg 33 into a fixed position with respect to the tube and center support 40.

Figure 13:
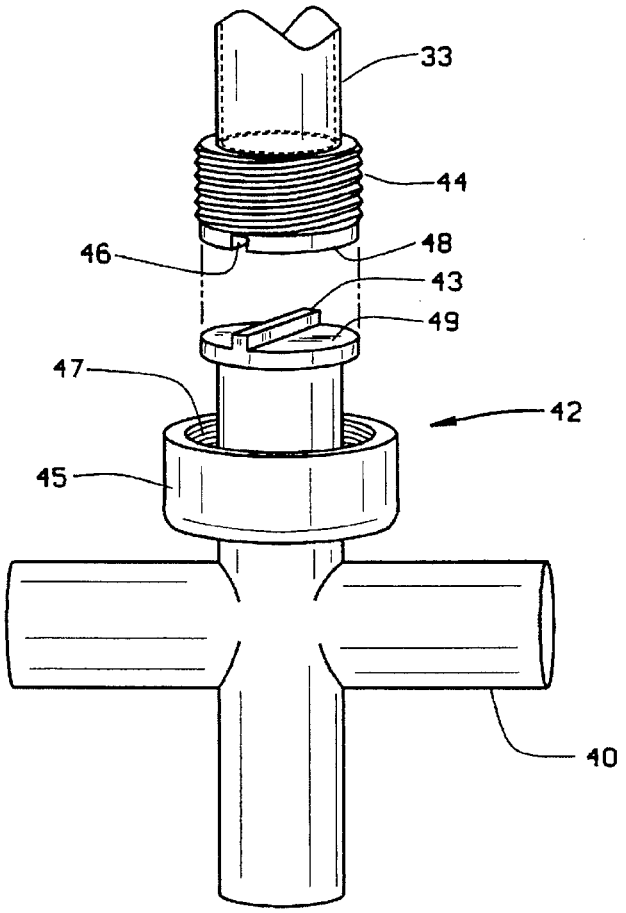
FIG. 13 illustrates a sixth embodiment of the connecting device in its disengaged or unlocked position.

As shown in FIG. 13, the inwardly extending end of leg 33 may be cylindrical in shape and have a threaded pattern 44 formed therein as well as a slot 46 formed in the base 48 of the leg 33. The connecting device 42 has a notch 43 protruding outwardly from its base 49 which is slidably received in the slot 46 of the leg 33 upon assembly of the antenna 20. The connecting device 42 also includes a rotatable cylindrical fastener 45 having a threaded interior surface 47 which is adapted to be screwed into engagement with the threaded portion 44 of the leg 33 to further secure the leg 33 to the center support 40. The antenna 20 may be collapsed by unscrewing the fastener 45 and slidably removing notch 43 from slot 46.

If the antenna 20 is constructed so that two or more legs are not collapsible, these noncollapsible legs may be permanently molded together so that the center support 40 is not necessary. In this situation, the connecting devices 42 are mounted directly on the noncollapsible legs at their intersection in an appropriate location to receive the collapsible legs upon assembly of the antenna 20. For example, the antenna 20 illustrated in FIG. 1 could be constructed without the center support 40 since legs 31 and 32 are not collapsible. The legs 31 and 32 would be permanently joined together to form the boom 36 and the connecting devices 42 would be mounted to the midpoint of the boom 36 in oppositely extending directions. Upon assembly of the antenna 20, legs 33 and 34 are secured within the connecting devices 42 so as to extend perpendicularly from the midpoint of the boom 36 in opposite coaxial directions.

Figure 14:
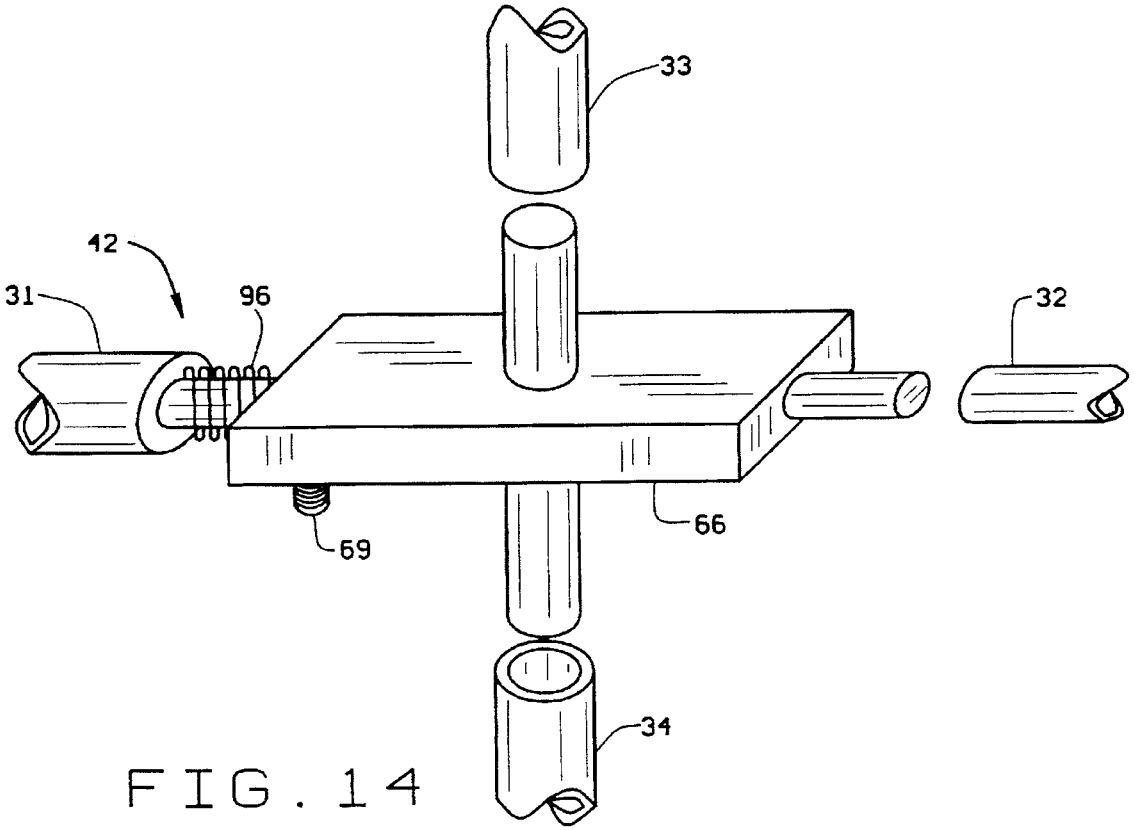
FIG. 14 depicts a sectional side view of a center mounted translation device with the legs of the antenna frame and a connecting device attached to the translation device.

Alternatively, the housing 66 of a translation device 65 may be used in place of the center support 40 (FIG. 14). In this situation, the legs are either mounted directly on the housing 66 or in engagement with a connecting device 42 (e.g., leg 31 in FIG. 14) which is mounted on the housing so that the legs extend radially outwardly from the housing 66. The housing 66 can be made of a conductive material.

The antenna frame 24 also includes four nonconductive cross arm supports 51, 52, 53, and 54 which support the wire antenna elements 22 in their rhomboid shape. As shown in FIGS. 1–2, each cross arm support 51, 52, 53, 54 is connected orthogonally in the vicinity of the outwardly extending end of each legs 31, 32, 33, 34, respectively. Furthermore, each cross arm support 51, 52, 53, 54 is disposed in a parallel fashion to the other cross arm supports. The cross arm supports 51, 52, 53, 54 have a plurality of openings 56 formed therein for reception of a wire element 22 therethrough.

Figure 4A:
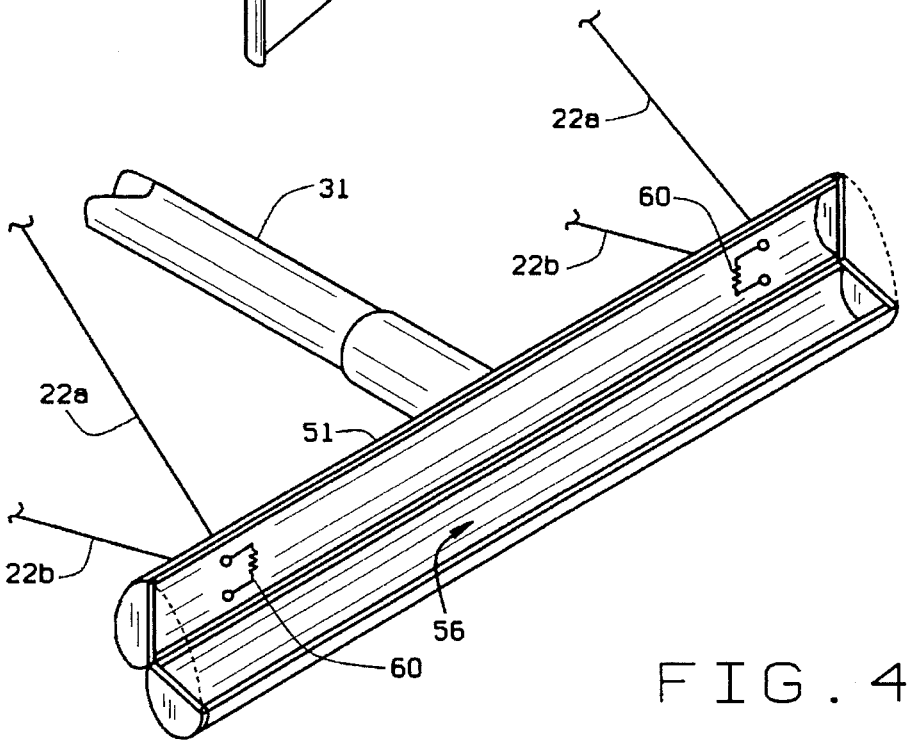
FIG. 4A is an exploded view of a cross arm support used in the two element rhombic antenna showing a pair of termination resistors housed therein.
Figure 4B:
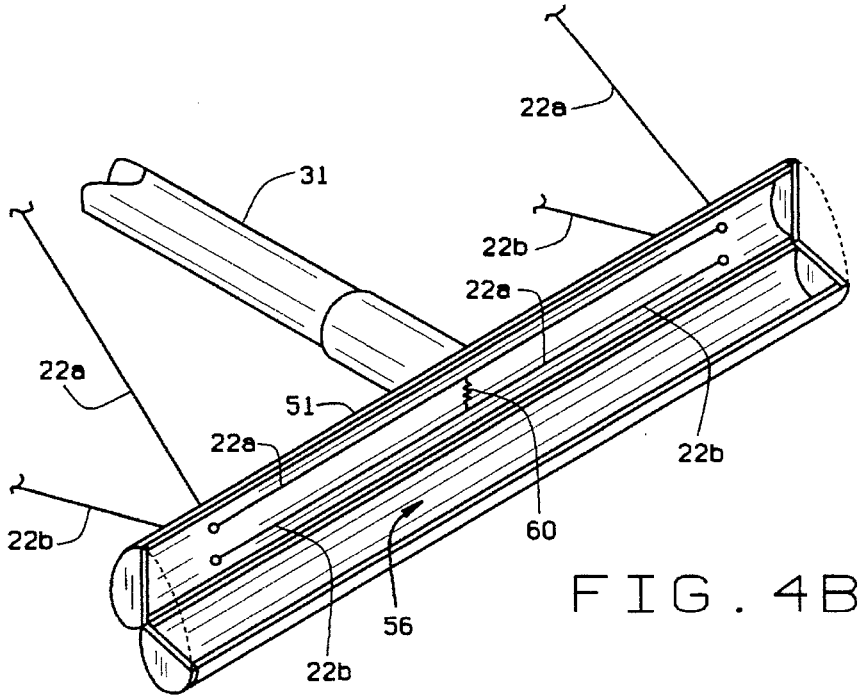
FIG. 4B is an exploded view of a cross arm support used in the two element rhombic antenna showing a single termination resistor housed therein.

Each four sided wire antenna element 22 is formed by two wires 22*a* and 22*b*. Wire 22*a* defines a first half (or two sides) of each rhombic element 22. The first half includes the side extending between cross arm supports 51 and 54 and the side extending between cross arm supports 54 and 52. Element 22*b* defines a second half (or the two remaining sides) of each rhombic element 22. The second half includes the side extending between cross arm supports 51 and 53 and the side extending between cross arm supports 53 and 52. As is common in most rhombic antennas, each wire 22*a* and 22*b* is terminated at each end by a resistance, called a termination resistor 60. The termination resistor 60 of this invention is housed within the opening 56 of cross arm support 51, as shown in FIGS. 4A and 4B. FIG. 4A shows one possible construction of the antenna 20 having two termination resistors 60 housed within cross arm support 51 and connected between wires 22*a* and 22*b*. An alternative embodiment is shown in FIG. 4B wherein one termination resistor 60 is connected between wires 22*a* and 22*b*. The termination resistor 60 operatively connects the wires 22*a* and 22*b* to each other to form the rhombic elements. More specifically, in FIG. 4A, one terminal of each termination resistor 60 is connected to wire 22*a* while the other terminal of that resistor 60 is connected to wire 22*b* (see FIG. 4). Likewise, for the single element rhombic antenna, wire 22*a* is connected to one terminal of a single termination resistor 60 and wire 22*b* is connected to the other terminal of the termination resistor 60. The length of the sides of the rhombus, the angle between the sides, the elevation of the antenna 20 above ground, and the value of the termination resistors 60 are proportioned to give the antenna 20 the desired operational properties.

Figure 5A:
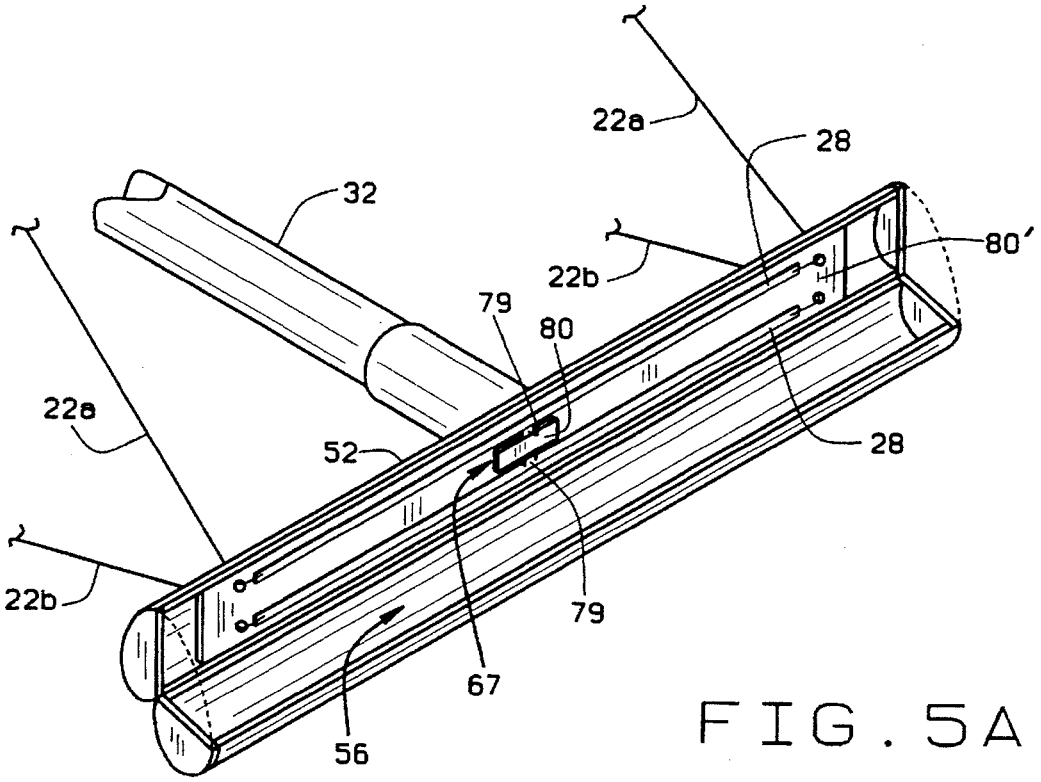
FIG. 5A is an exploded view of a cross arm support used in the two element rhombic antenna showing an attachment scheme for the integrated feed network and the translation device.
Figure 5B:
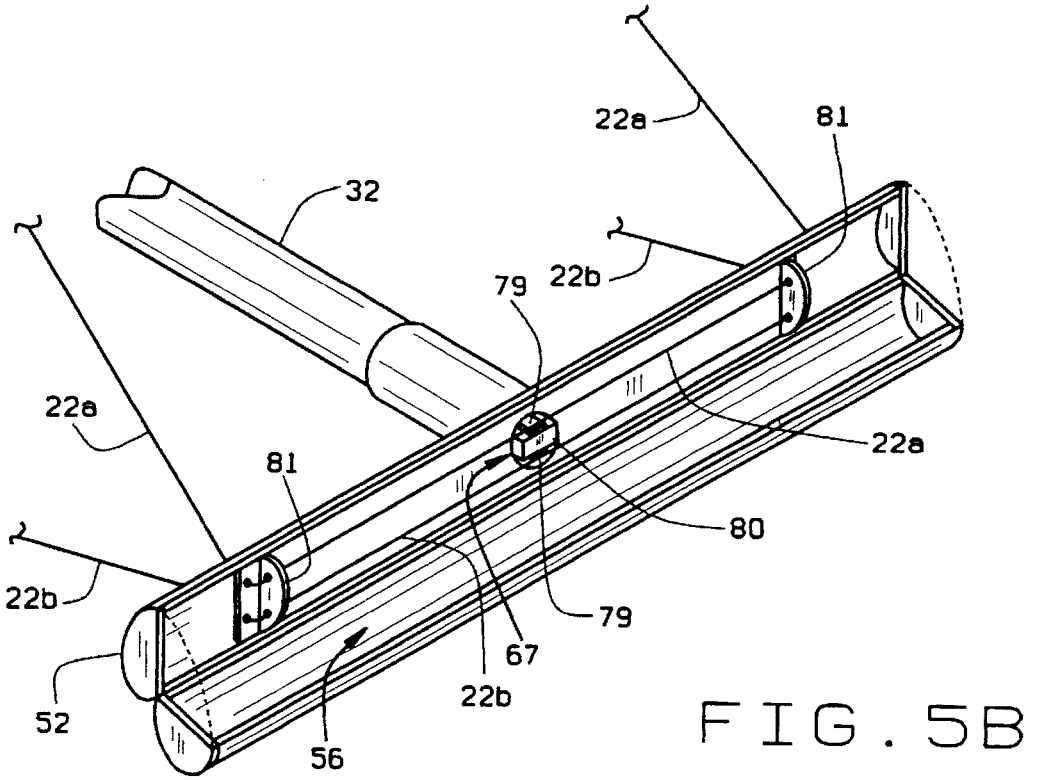
FIG. 5B is an exploded view of the cross arm support showing an alternate attachment scheme using a wire transmission line to attach to the translation device.
Figure 15A:
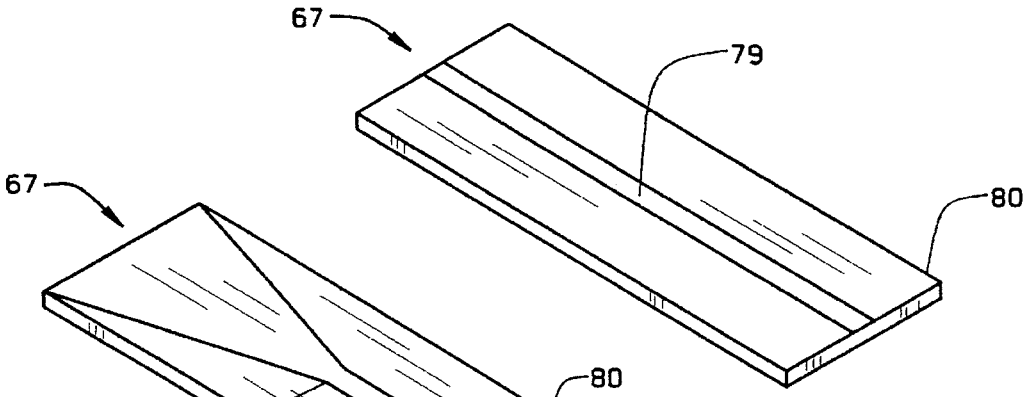
FIG. 15A illustrates a top plan view of the balun used to connect the wire antenna elements to the translation device.
Figure 15B:
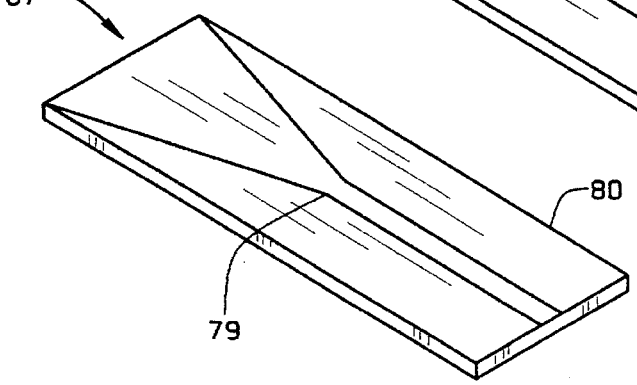
FIG. 15B illustrates a bottom plan view of the balun used to connect the wire antenna elements to the translation device.

FIG. 5A is an exploded view of the cross arm support 52 illustrating one possible embodiment of an integrated feed network for guiding electromagnetic waves to or from the translation device 65 including a coplanar strip transmission line having two parallel thin conducting strips 28 of finite width and thickness, separated by a finite gap and affixed to the same plane surface of an insulating substrate 80' of arbitrary thickness. The substrate 80' is preferably constructed from a dielectric material. The characteristic impedance for the strip transmission line may vary based upon adjustment of the strip 28 width, thickness and separation gap distance as well as adjustment of the dielectric constant and thickness of the substrate 80. The conducting strips 28 are connected to the translation device 65 either directly or via a balanced to unbalanced transformer (balun) 67 and a transmission line 82. This construction only requires variation of the dimensions associated with the conducting strips 28 or the substrate 80 housed within the opening 56 of cross arm support 52 to obtain bandwidth control. The overall dimensions of the antenna frame remain unchanged. When a transmission line 82 is used to connect the translation device 65 to the integrated feed network, a balun 67 is generally required. The preferred embodiment of the balun 67 used in FIG. 5A is shown in FIGS. 15A and 15B. The balun 67 includes two conducting elements 79 separated by an insulating substrate 80 of arbitrary thickness. FIG. 15A shows the top plan view of the balun 67 with conducting element 79 and FIG. 15B shows its bottom plan view with conducting element 79. The conducting strips 28 are coupled to the conducting elements 79 as shown in FIGS. 5A and 5B. Using microstrip techniques, the strip width and thickness are varied along with the substrate dielectric constant width and thickness to obtain the desired impedance matching characteristics.

FIG. 5B shows an alternate feed network where wires 22*a* and 22*b* are threaded through a support 81 which separates wire 22*a* from wire 22*b* by a finite distance. Wires 22*a* and 22*b* are affixed to the conducting elements 79 associated with the balun 67 where conducting elements 79 are separated by a finite distance by the insulating substrate 80. The distance between the segments of wires 22*a* and 22*b* disposed between supports 81 can be varied to increase or decrease the antenna bandwidth. As discussed with respect to FIG. 5A, this method of bandwidth control allows for the structure of the antenna frame 24 to have fixed dimensions while only the distance between the two segments of wires 22*a* and 22*b* housed within the opening of cross arm support 52 varies. The wires 22 are connected to a radio frequency (RF) input 68 associated with the translation device 65 either directly or via the balun 67 and the transmission line 82. In other words, wires 22*a* and 22*b* are operatively connected to the translation device 65 via the integrated feed network. Similarly, for the single element rhombic antenna, wires 22*a* and 22*b* are connected to the RF input 68 either directly or indirectly via the balun 67 and transmission line 82. A single element antenna may be constructed with a collapsible frame without an integrated feed network. In this configuration, the translation device may still be mounted internally to the wire element 22 and coupled to the wire element via the transmission line 82, the balun 67 and an impedance match network.

Figure 6A:
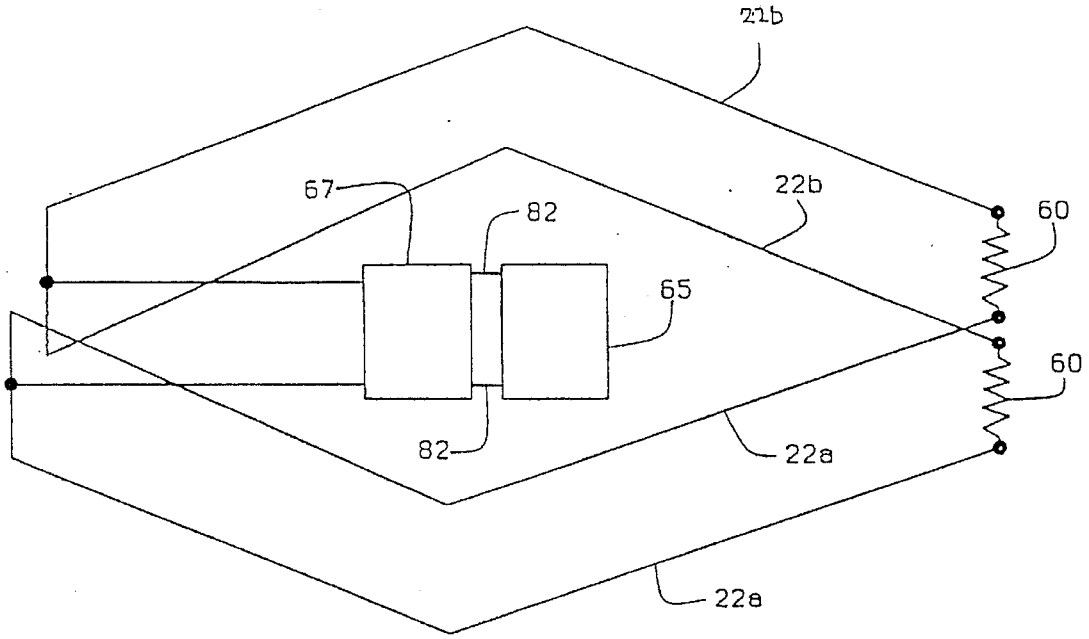
FIG. 6A is a schematic diagram of the circuitry employed in the two element rhombic antenna having two termination resistors.
Figure 6B:
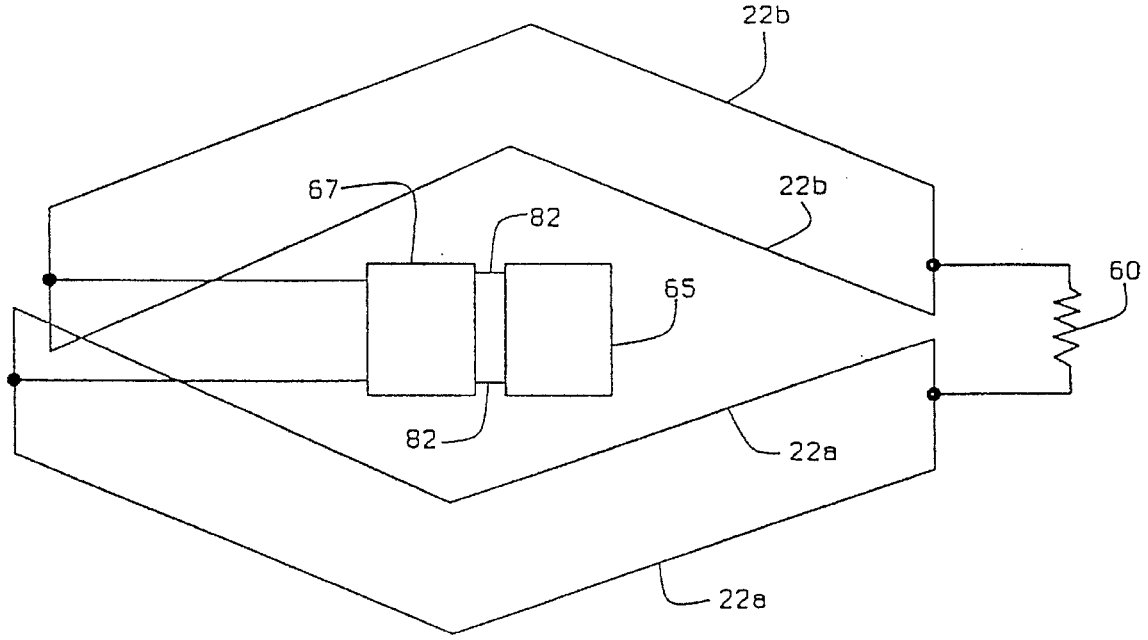
FIG. 6B is a schematic diagram of the circuitry employed in the two element rhombic antenna having one termination resistor.

FIGS. 6A and 6B are schematic diagrams of the electrical connections associated with the integrated feed network for the two element rhombic antenna 20. FIG. 6A is a schematic diagram of the rhombic antenna 20 employing two termination resistors 60 as shown in FIG. 4A. FIG. 6B is a schematic diagram of the rhombic antenna 20 employing only one termination resistor 60 as shown in FIG. 4B. The translation device 65 is disposed within the enclosure 26 defined by wires 22*a* and 22*b*. The translation device 65 is coupled to the wires 22 either directly, or indirectly via a balun 67 and transmission line 82 as shown in FIGS. 6A and 6B. Wire 22*a* and wire 22*b* each provide a balanced input signal to the balun 67. The balun 67 matches the impedance of the integrated feed network taken from the wire antenna elements 22 to the input impedance of the translation device 65 to produce the desired signal transmission. The termination resistors 60 dissipate any reflected currents from the impedance mismatch between the integrated feed network and the wire antenna elements 22. In addition to controlling the bandwidth by varying the spacing between the segments of wires 22*a* and 22*b* or the strips 28 located in cross arm support 52, the impedance of the translation device 65 also may be adjusted by the balun 67 to vary the operating bandwidth of the antenna. The effective gain of the antenna is increased by controlling the bandwidth to lower the noise floor. The operating frequency wavelength of the rhombic antenna 20 is less than six inches. The output of the balun 67 is then supplied to the translation device 65 which amplifies and converts the electromagnetic signals received by the wire elements 22 into an analog or digital signal at the desired reception frequency. The translation device 65 includes a frequency conversion device such as a down converter to convert the electromagnetic signals to the desired output signal where the frequency of the desired output signal is lower than the frequency of the electromagnetic waves. The translation device 65 may be used to convert the electromagnetic radiation associated with a wireless cable television signal into a signal as used in direct television transmissions.

Figure 7A:
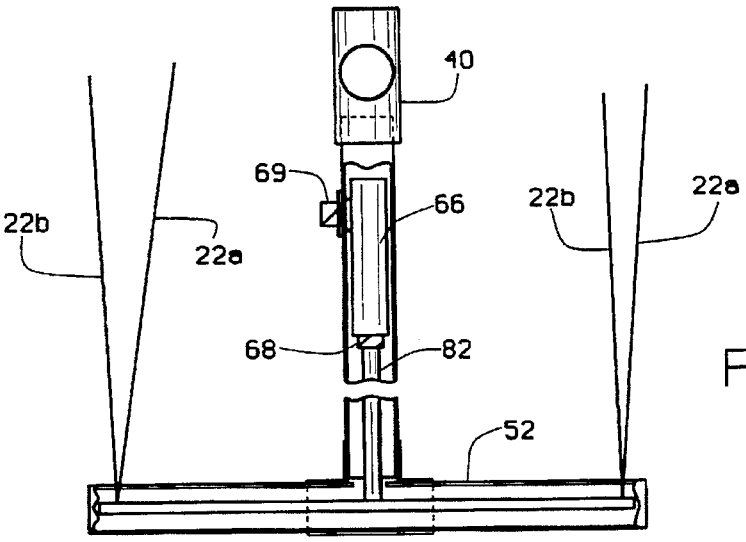
FIG. 7A is a sectional view of the two element rhombic antenna showing the attachment scheme for the translation device when it is mounted within the antenna frame near the center support.
Figure 7B:
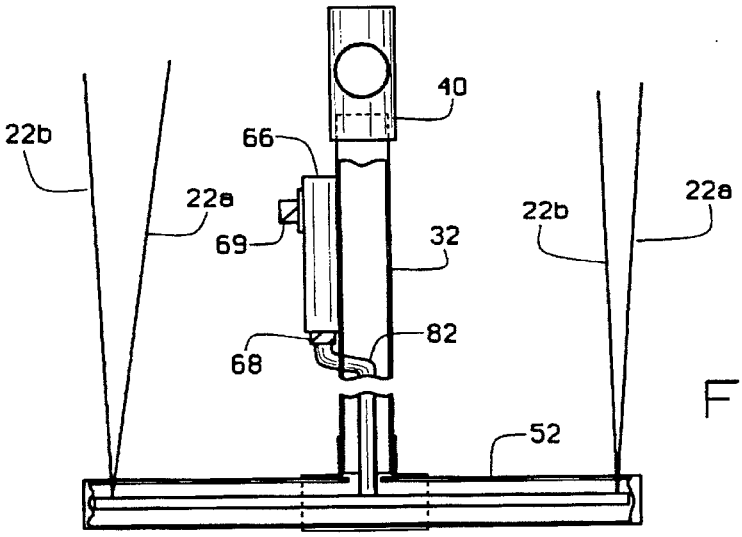
FIG. 7B is a sectional view of the two element rhombic antenna showing the attachment scheme for the translation device when it is mounted on the exterior surface of the antenna frame near the center support.
Figure 7C:
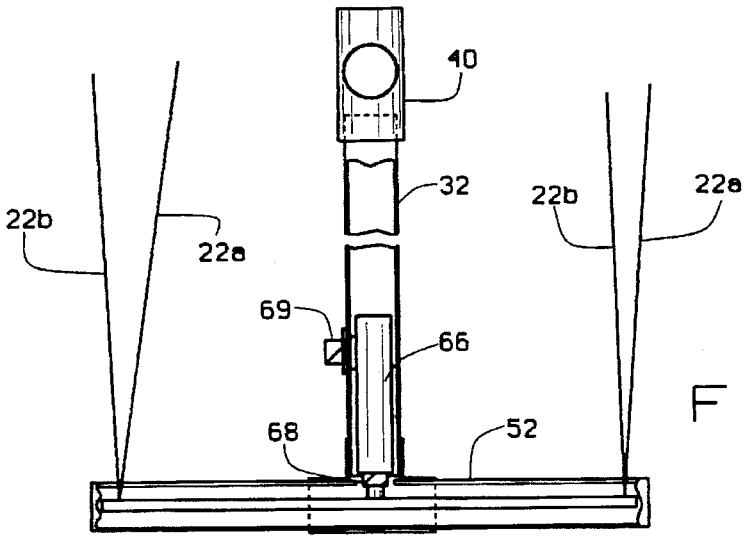
FIG. 7C is a sectional view of the two element rhombic antenna showing the attachment scheme for the translation device when it is mounted within the antenna frame near a cross arm support.

While the translation device 65 can be mounted outside the enclosure defined by the wire elements 22, it alternatively may be mounted either internally or externally to the frame 24 within the enclosure 26 defined by the wire elements 22 as shown in FIGS. 7A, 7B and 7C. The translation device 65 may be contained in a housing 66 which provides protection from the environment when mounted on the outside of leg 32 as shown in FIG. 7B. The RF input 68 to the translation device 65 is connected to wires 22*a* and 22*b* or the conducting strips 28 in the manner discussed above in reference to FIGS. 5A and 5B. The wires 22*a*, 22*b* or strips 28 may be attached directly to the RF input 68 as shown in FIG. 7C to allow for mounting of the translation device 65 inside the leg 32 in close proximity to the cross arm support 52. The wires 22*a*, 22*b* or strips 28 alternatively may be connected to the transmission line 82 which is then connected to the RF input 68 as shown in FIGS. 7A and 7B. When the transmission line 82 is used, the translation device 65 can be mounted internally or externally to the leg 32 in close proximity to the center support 40 (FIGS. 7A and 7B). An RF output is designated generally at 69 in FIGS. 7A, 7B and 7C. In the preferred embodiment as shown in FIG. 1, the RF output 69 extends from leg 32 (as shown in FIG. 7A) and may be connected to an RF output connector via a cable which extends outwardly from the RF output 69.

Upon assembly of the collapsible legs, the antenna 20 is mounted on a mast 76. The antenna frame 24 includes a vertical mast mount 72 attached to the outermost end of leg 34 extending coaxially and outwardly from the leg 34 and orthogonally to the cross arm support 54. The vertical mast mount 72 accepts the mast 76 for vertically polarized operation of the antenna 20 as shown in FIGS. 1 and 2. A horizontal mast mount 74 perpendicularly mounted to the center support 40 so that it is disposed orthogonally to the legs 31, 32, 33, 34. The horizontal mast mount 74 alternatively may be attached directly to noncollapsible legs at their point of intersection if the center support 40 is not employed so that the horizontal mast mount 74 extends orthogonally to the legs 31, 32, 33, 34 upon assembly of the antenna 20. The horizontal mast mount 74 accepts the mast 76 for horizontally polarized operation as shown in FIG. 3.

The foregoing description is set forth only for illustrative purposes only and is not meant to be limiting. Numerous variations, within the scope of the appended claims will be apparent to those skilled in the art in light of the foregoing description and accompanying drawings. Merely by way of example, the configuration of the various support elements may vary. While certain preferred materials for component parts were described, those skilled in the art will recognize other available materials also are acceptable. Likewise, the various interconnections of parts may be varied in other embodiments of our invention. These variations are merely illustrative.

Having thus described the invention, what is claimed and desired to be secured by Letters Patent is:

1. A collapsible rhombic antenna for receiving and transmitting horizontally or vertically polarized electromagnetic waves, comprising:

two parallel rhombic antenna elements including a first conductive wire defining a first half of each rhombic element and a second conductive wire defining a second half of each rhombic element;

an antenna frame for supporting said rhombic elements including a first pair of nonconductive coaxial legs extending radially outwardly from a center support, a second pair of nonconductive coaxial legs extending radially outwardly from said center support and orthogonally to said first pair of legs, and four nonconductive cross arm supports orthogonally mounted to an outwardly extending end of each leg for upholding each element in its rhomboid shape;

means for detachably engaging at least one of said legs to said center support;

a termination resistance disposed in an environmentally protected opening formed within the cross arm support upholding each end of said first and second wires, said resistance having a first terminal and a second terminal, said first wire being connected to the first terminal of said resistance, said second wire being connected to the second terminal of said resistance;

an integrated feed network for controlling the bandwidth of the antenna disposed in an environmentally protected opening formed within the cross arm support upholding the midpoints of both said first and second wires; and a translation device coupled to said first and second wires for detecting, amplifying and converting the electromagnetic waves into a desired output signal.

2. The collapsible rhombic antenna of claim 1 wherein said translation device is disposed within an enclosure delimited by said antenna wire elements.

3. The collapsible rhombic antenna of claim 2 wherein said translation device is disposed within a weather-proof housing mounted to the exterior surface of any leg.

4. The collapsible rhombic antenna of claim 3 wherein said housing is mounted to the exterior surface of the leg attached to the cross arm support housing said bandwidth controlling means.

5. The collapsible rhombic antenna of claim 2 wherein said translation device is disposed within a cavity defined by the interior surface of the leg attached to the cross arm support housing said bandwidth control means.

6. The collapsible rhombic antenna of claim 1 wherein a horizontal mast mount extends outwardly from said center support and orthogonally to said legs, said horizontal mast mount being removably secured to a mast for transmission or reception of horizontally polarized electromagnetic waves.

7. The collapsible rhombic antenna of claim 1 wherein a vertical mast mount extends coaxially outwardly from the outermost end of any leg, said vertical mast mount being removably secured to a mast for transmission or reception of vertically polarized electromagnetic waves.

8. The collapsible rhombic antenna of claim 1 wherein said termination resistance includes a pair of resistors, each resistor having a first terminal and a second terminal, said first wire being connected to the first terminal of each of said resistors, said second wire being connected to the second terminal of each of said resistors.

9. A collapsible rhombic antenna for receiving and transmitting horizontally or vertically polarized electromagnetic waves, comprising:

two parallel rhombic antenna elements for receiving and transmitting electromagnetic waves including a first conductive wire defining a first half of each rhombic element and a second conductive wire defining a second half of each rhombic element;

an antenna frame for supporting said rhombic elements including a first pair of nonconductive coaxial legs extending radially outwardly from a center support, a second pair of nonconductive coaxial legs extending radially outwardly from said center support and orthogonally to said first pair of legs, and four nonconductive cross arm supports orthogonally mounted to an outwardly extending end of each leg for upholding each element in its rhomboid shape;

means for detachably engaging at least one of said legs to said center support;

a termination resistor disposed in an environmentally protected opening formed within the cross arm support upholding each end of said first and second wires, said resistor having a first terminal and a second terminal, said first wire being connected to the first terminal of said resistor, said second wire being connected to the second terminal of said resistor;

means for controlling the bandwidth of the antenna disposed in an environmentally protected opening formed within the cross arm support upholding the midpoints of both said first and second wires; and a translation device coupled to said first and second wires for detecting, amplifying and converting the electromagnetic waves into a desired output signal, said translation device being disposed within an enclosure delimited by said antenna wire elements.

10. A collapsible rhombic antenna for receiving and transmitting horizontally or vertically polarized electromagnetic waves, comprising:

at least one rhombic antenna element for receiving and transmitting electromagnetic waves including a first conductive wire defining a first half of said rhombic antenna element and a second conductive wire defining a second half of said rhombic antenna element;

an antenna frame for supporting said rhombic antenna element including a first pair of nonconductive coaxial legs extending radially outwardly from a center support, a second pair of nonconductive coaxial legs extending radially outwardly from said center support and orthogonally to said first pair of legs, and four nonconductive cross arm supports orthogonally mounted to an outwardly extending end of each leg for upholding said antenna element in its rhomboid shape;

a termination resistor disposed in an environmentally protected opening formed within the cross arm support upholding each end of said first and second wires, said resistor having a first terminal and a second terminal, said first wire being connected to the first terminal of said resistor, said second wire being connected to the second terminal of said resistor; and a translation device coupled to said first and second wires for detecting, amplifying and converting the electromagnetic waves into a desired output signal, said translation device being disposed within an enclosure delimited by said rhombic antenna element.

11. The collapsible antenna of claim 10 further including means for detachably engaging at least one of said legs to said center support.

12. The collapsible antenna of claim 10 further including means for controlling the bandwidth of the antenna disposed in an environmentally protected opening formed within the cross arm support upholding the midpoints of both said first and second wires.

13. A rhombic antenna, comprising:

at least two wire antenna elements for receiving and transmitting electromagnetic waves;

an antenna frame for supporting each of said elements in a rhombic formation;

an integrated feed network coupled to said wire antenna elements for combining electromagnetic waves upon their reception and controlling the bandwidth of said rhombic antenna; and a translation device coupled to said integrated feed network for detecting, amplifying and converting the electromagnetic waves into a desired output signal, said translation device being mounted within an enclosure defined between said antenna wire elements, said integrated feed network matching the impedance of said antenna elements to an input impedance of said translation device;

said antenna frame including a first nonconductive leg and a second nonconductive leg extending coaxially outwardly from a center support in opposite directions to form a first diagonal of the rhombic formation, a third nonconductive leg and a fourth nonconductive leg extending coaxially outwardly from said center support in opposite directions to form a second diagonal of the rhombic formation, and means for detachably engaging at least one of said legs to said center support;

said antenna frame further including four nonconductive cross arm supports orthogonally mounted to an outwardly extending end of each leg for upholding each wire antenna element in its rhombic formation, each cross arm support being disposed in a generally parallel fashion to the other cross arm supports;

said integrated feed network being contained within an opening formed within one of said cross arm supports;

said integrated feed network including two parallel conducting strips having a finite width and thickness coupled to said antenna elements, said conducting strips being separated by a finite distance and affixed to an insulating substrate of a predetermined thickness, said integrated feed network providing impedance matching and bandwidth control by varying the strip width and thickness and the substrate width and thickness.

14. A rhombic antenna, comprising:

two wire antenna elements for receiving and transmitting electromagnetic waves, each of said elements being constructed by a segment of a first conductive wire and a segment of a second conductive wire, said first wire defining two sides of a rhombic formation, said second wire defining the two remaining sides of the rhombic formation;

an antenna frame for supporting each of said elements in the rhombic formation;

an integrated feed network coupled to said wire antenna elements for combining electromagnetic waves upon their reception and controlling the bandwidth of said rhombic antenna; and a translation device coupled to said integrated feed network for detecting, amplifying and converting the electromagnetic waves into a desired output signal, said translation device being mounted within an enclosure defined between said antenna wire elements, said integrated feed network matching the impedance of said antenna elements to an input impedance of said translation device;

said antenna frame includes a first nonconductive leg and a second nonconductive leg extending coaxially outwardly from a center support in opposite directions to form a first diagonal of the rhombic formation, a third nonconductive leg and a fourth nonconductive leg extending coaxially outward from said center support in opposite directions to form a second diagonal of the rhombic formation, and means for detachably engaging at least one of said legs to said center support;

said antenna frame further including four nonconductive cross arm supports orthogonally mounted to an outwardly extending end of each leg for upholding each wire antenna element in its rhombic formation, each cross arm support being disposed in a generally parallel fashion to the other cross arm supports;

a pair of termination resistors being mounted in a weatherproof opening formed within the cross arm support upholding each end of said first and second wires, each resistor having a first terminal and a second terminal, the ends of said first wire being connected to the first terminals of both resistors, the ends of said second wire being connected to the second terminals of both resistors.

* * * * *